US005509343A

United States Patent [19]

Hsu

[11] Patent Number: 5,509,343

[45] Date of Patent: Apr. 23, 1996

[54] TAMBOURINE WITH LIGHT CONTROL EFFECT

[76] Inventor: Yu-yin C. Hsu, No. 18-7, Alley 22, Lane 265, Tai Ping Rd., Tai Ping Hsiang, Taichung Hsien, Taiwan

[21] Appl. No.: 345,442

[22] Filed: Nov. 21, 1994

[51] Int. Cl.[6] ..... G10D 13/02; A63J 17/00

[52] U.S. Cl. ..... 84/418; 84/464 A

[58] Field of Search ..... 84/418, 464 A

[56] References Cited

U.S. PATENT DOCUMENTS

| | | | |
|---|---|---|---|
| 4,091,706 | 5/1978 | Ludwig | 84/464 |
| 4,230,015 | 10/1980 | Taninbaum | 84/418 |
| 4,346,637 | 8/1982 | Janszen | 84/418 |
| 5,040,446 | 8/1991 | Cohen et al. | 84/418 |

*Primary Examiner*—Cassandra C. Spyrou

*Attorney, Agent, or Firm*—Bacon & Thomas

[57] ABSTRACT

An improved tambourine with a light control effect is disclosed having on a tambourine collar several luminous bodies (e.g. LED) controlled by a sound control circuit. The sound control circuit board is secured within a handle having upper and lower handle seats attached together and to the tambourine collar. A battery cover and circuit board seat are located within the handle. The tambourine collar has several cable protecting covers on the tambourine collar. A flashing effect is given when the tambourine is struck by the player.

2 Claims, 8 Drawing Sheets

TAMBOURINE WITH LIGHT CONTROL EFFECT

BACKGROUND OF THE INVENTION

This invention relates to an improvement for a tambourine with light control effect, and particularly to a structural improvement for a tambourine with a light control effect.

In general the conventional type of tambourine has no light control effect: and the mood is fabricated solely on the sound effect produced by the player striking the tambourine. Although it still gives some audible effect a better field effect cannot be achieved, for it is too boring to attract the audiences so the effect of the tambourine cannot be increased.

SUMMARY OF THE INVENTION

The invention comprises a pivotal connection seat on the upper and lower seats of a handle, a battery cover for enclosing a battery holder, a circuit board and seat for securing said light control circuit board, and several cable protecting covers on the collar of the tambourine for protecting the cable on the collar of the tambourine. The collar of the tambourine is set in the handle to produce flashing when the player is striking the tambourine in order to increase the light effect on the stage.

The other objects and advantages: of the present invention will become apparent to those skilled in the art after considering the following detailed specification together with the accompanying drawings.

DETAILED DESCRIPTION OF THE PREFERRED EMBODIMENT

Figure 1:
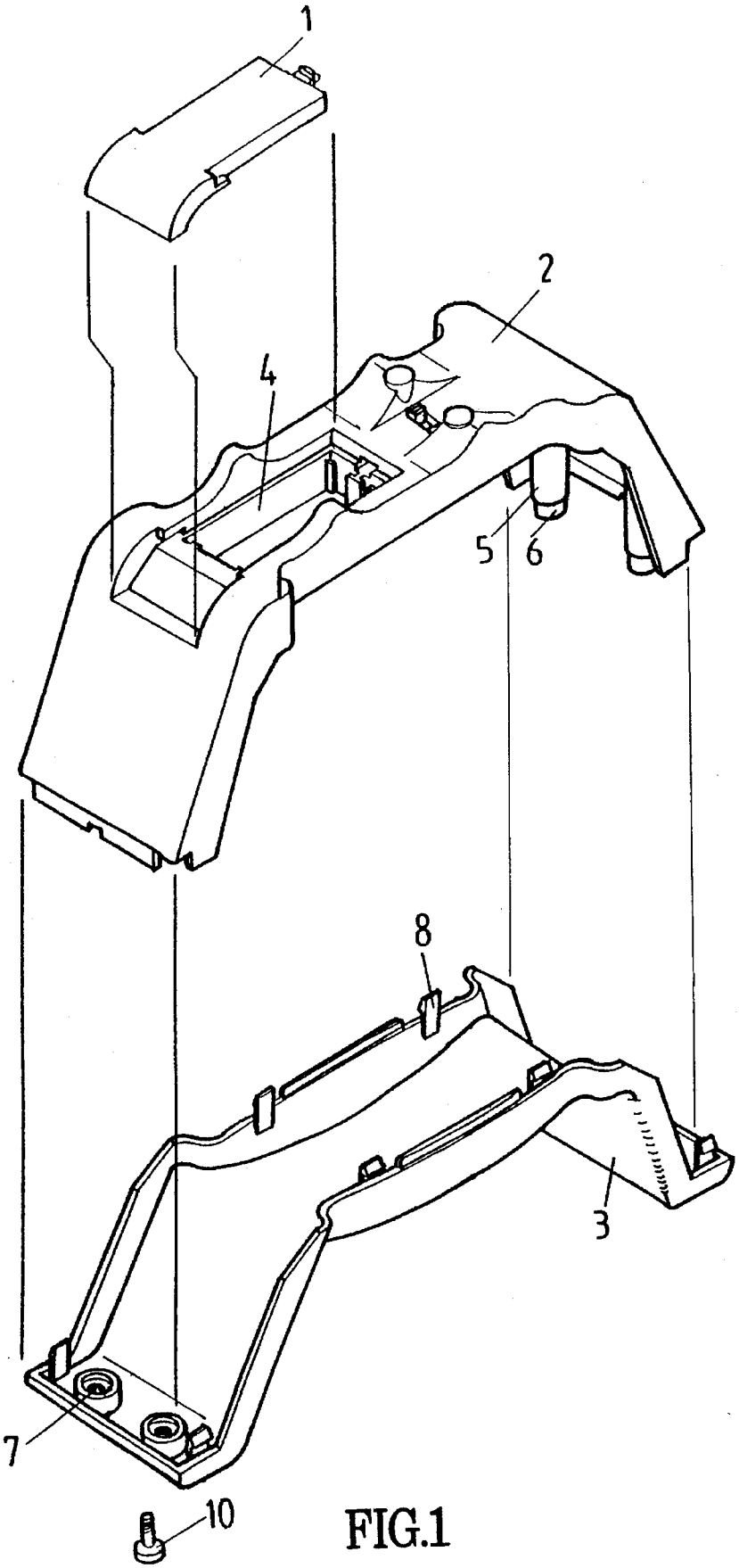
FIG. 1 is an exploded perspective view of the tambourine handle of the present invention.

Referring to FIGS. 1 and 2, the handle of the tambourine of the present invention comprises a battery cover 1 having a flange for locking up with an upper seat 2 on the handle, the handle upper seat 2 shaped to fit the hand of a user and containing a battery holder 4 for loading a battery; fixing posts 12 for mounting a circuit board 11; a handle lower seat 3 for attaching together with the handle upper seat 2, and the bottom of which resembles an arch for fitting with a hand of a user; each end of handle lower seat 3 has setting hole 7 for setting the post 6 of the handle upper seat 2 with the collar 20 of tambourine (See FIG. 3) for attachment within the handle by means of a screws 10; and retaining block 8 of handle lower seat 3 engages the retaining slot 9 of the handle upper seat 2.

Figure 2B:
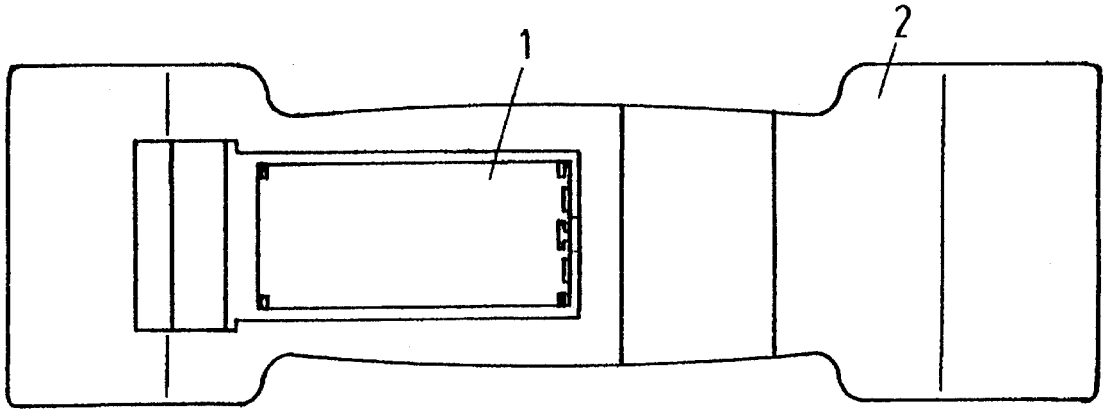
FIG. 2B is a top view of the tambourine handle of FIG. 2A.
Figure 2A:
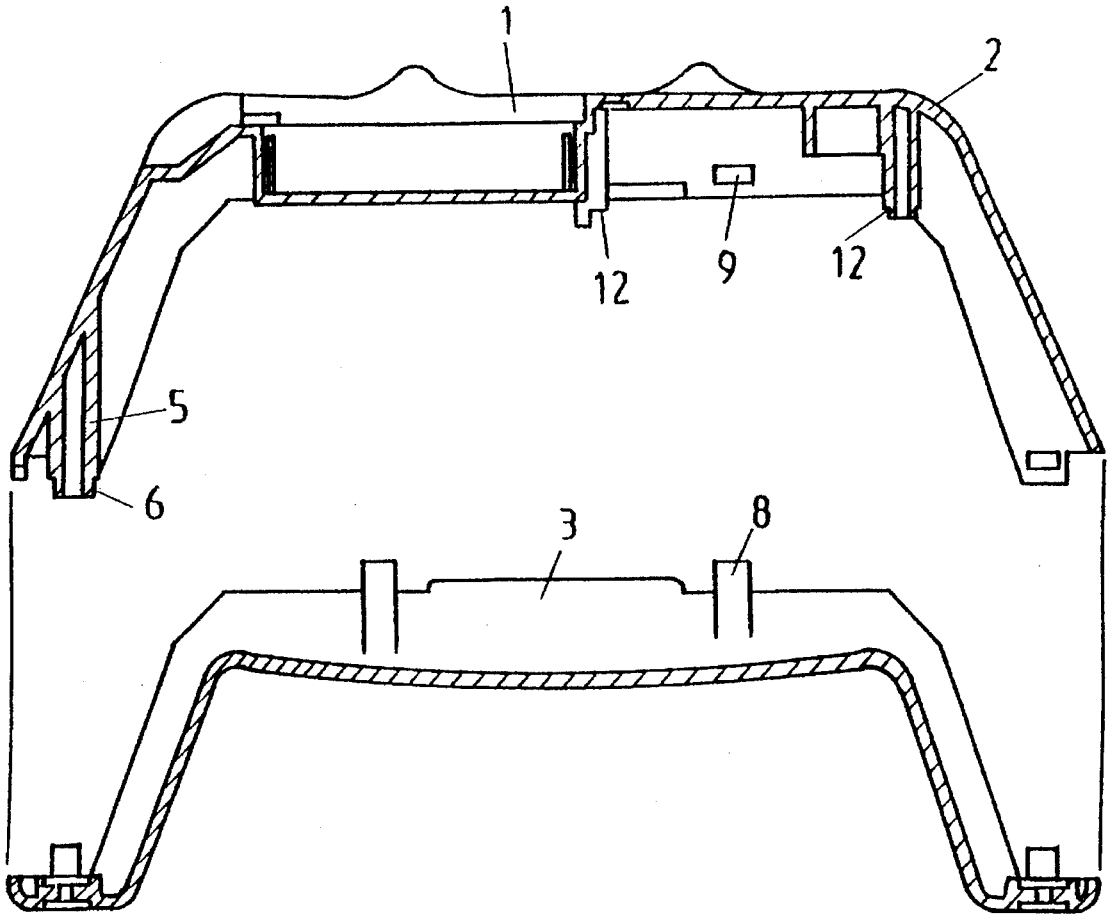
FIG. 2A is an exploded, cross-sectional side view of the tambourine handle according to the present invention.
Figure 2C:
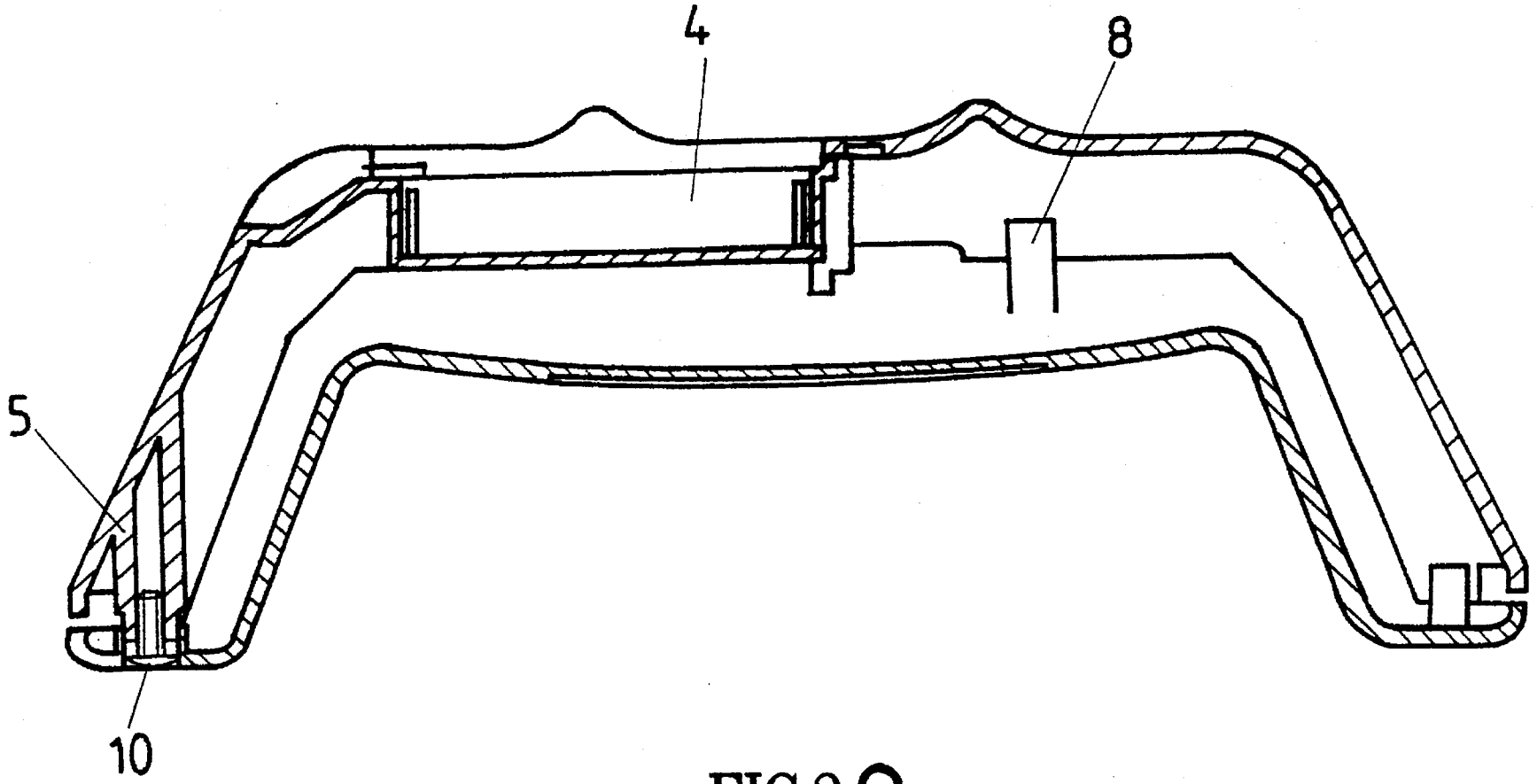
FIG. 2C is a cross-sectional view of the tambourine handle of FIGS. 2A and 2B.
Figure 3A:
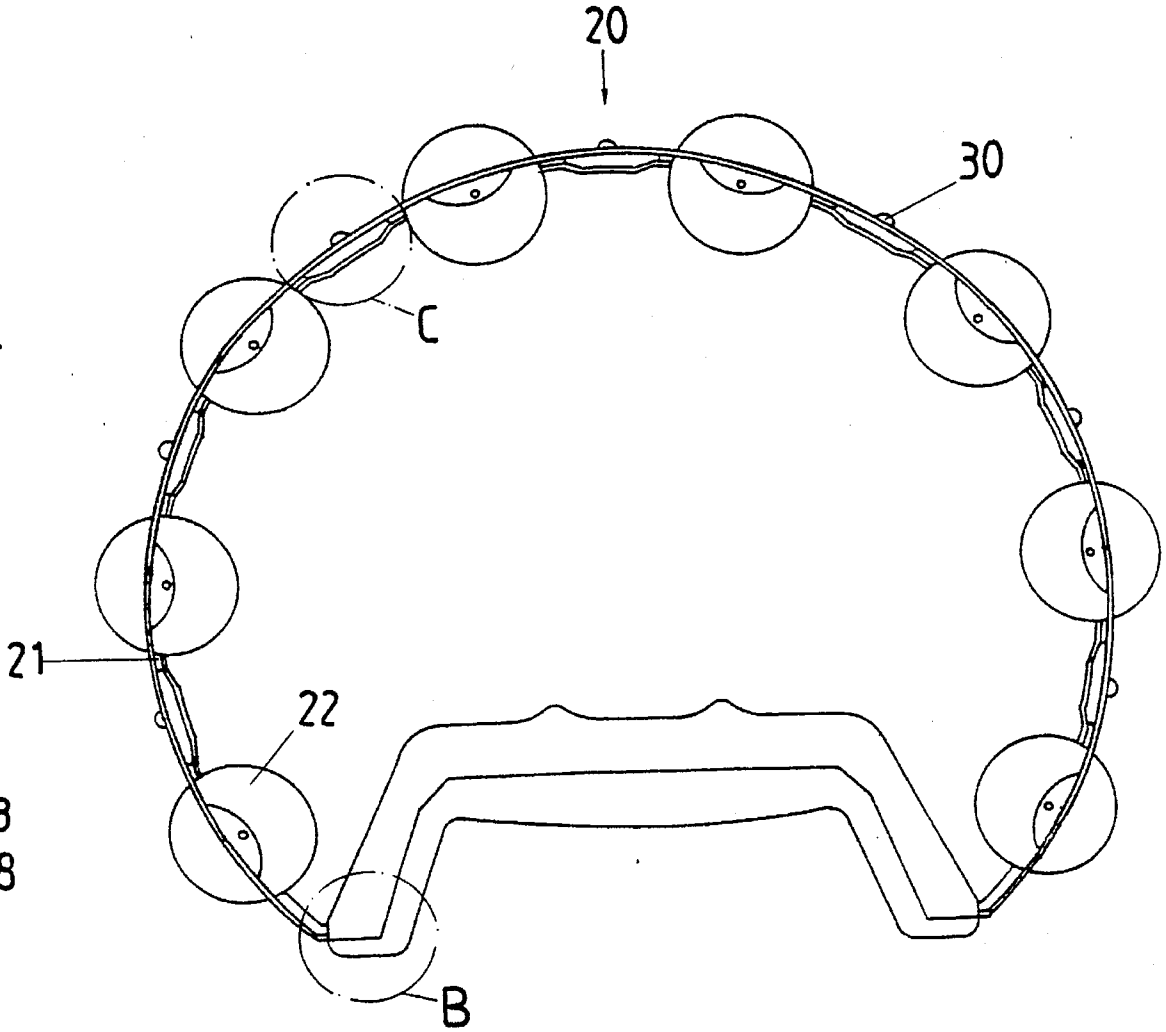
FIG. 3A is a side view of a tambourine according to the present invention.

Referring to FIGS. 2A, 2B and 2C, the handle upper seat 2 has a battery holder 4 for loading a battery therein; the interior of the handle upper seat has fixing posts 12 for securing a circuit board 11 to the seat 2; each end has a covering post 5 for giving support when the handle upper seat 2 is attached to the handle lower seat 3. Covering post 5 has setting post 6 for attaching together with handle lower seat 3 with setting hole 7. Handle lower seat 3 also contains several retaining blocks 8 for engagement with retaining slots 9 of the handle upper seat 2. As illustrated, the upper seat 2 and the lower seat 3 have a generally "J" shaped configuration. Referring to FIG. 2 again, handle upper and lower seats 2 and 3 have no risk of shaking and breaking apart due to the setting, retaining and locking by screws 10.

Figure 3C:
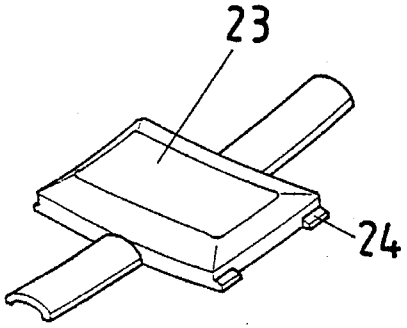
FIG. 3C is an enlarged perspective view of area C in FIG. 3A.
Figure 3B:
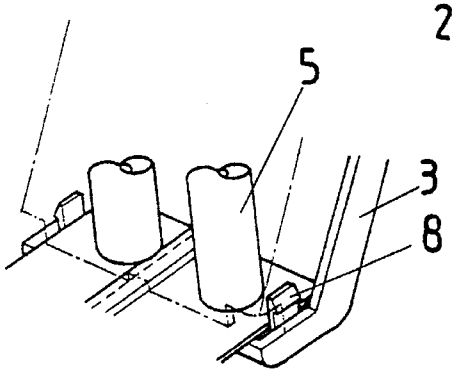
FIG. 3B is an enlarged perspective view of area B in FIG. 3A.
Figure 4:
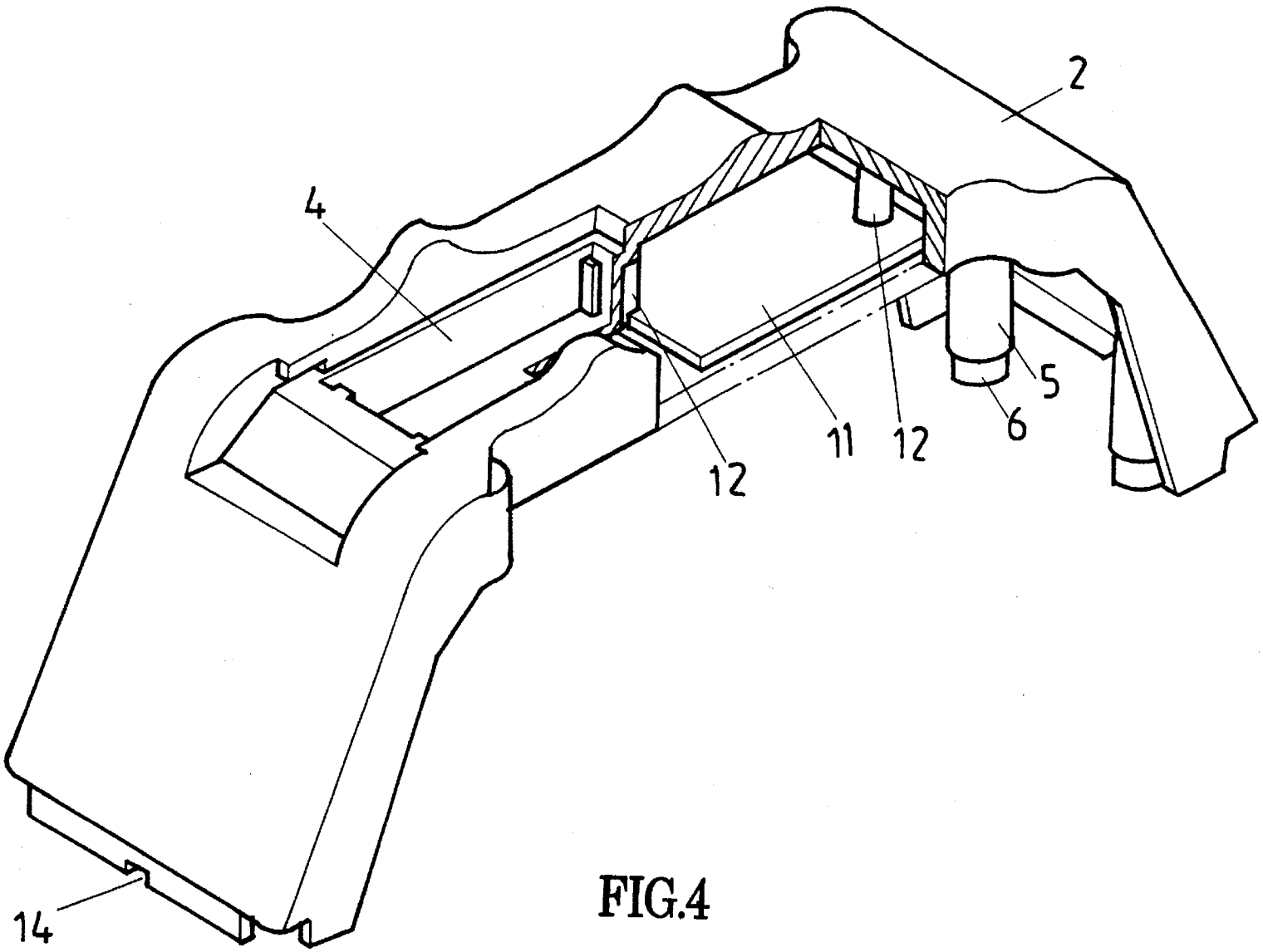
FIG. 4 is a perspective view, partially broken away, of a tambourine handle according to the present invention.

Referring to FIGS. 3A, 3B, 3C and 4, when the present handle is assembled together with the collar 20 of the tambourine, the collar 20 of the tambourine will be set between the setting post 6 and setting hole 7 to attach the collar 20 tightly in the setting seat. As seen in FIG. 3B, the retention and setting of the upper and lower seats 2 and 3 is well achieved. Referring to FIG. 3C, on the inner circumference of tambourine collar 20 is a cable connecting a luminous body (e.g. LED), and a cable protecting cover 23 for locking within the collar 20 of the tambourine. Cable protecting cover 23 has retaining block 24 for locating the cable protecting cover 23 within retaining slot 21 of the tambourine collar 20 without risk of slipping.

Figure 5:
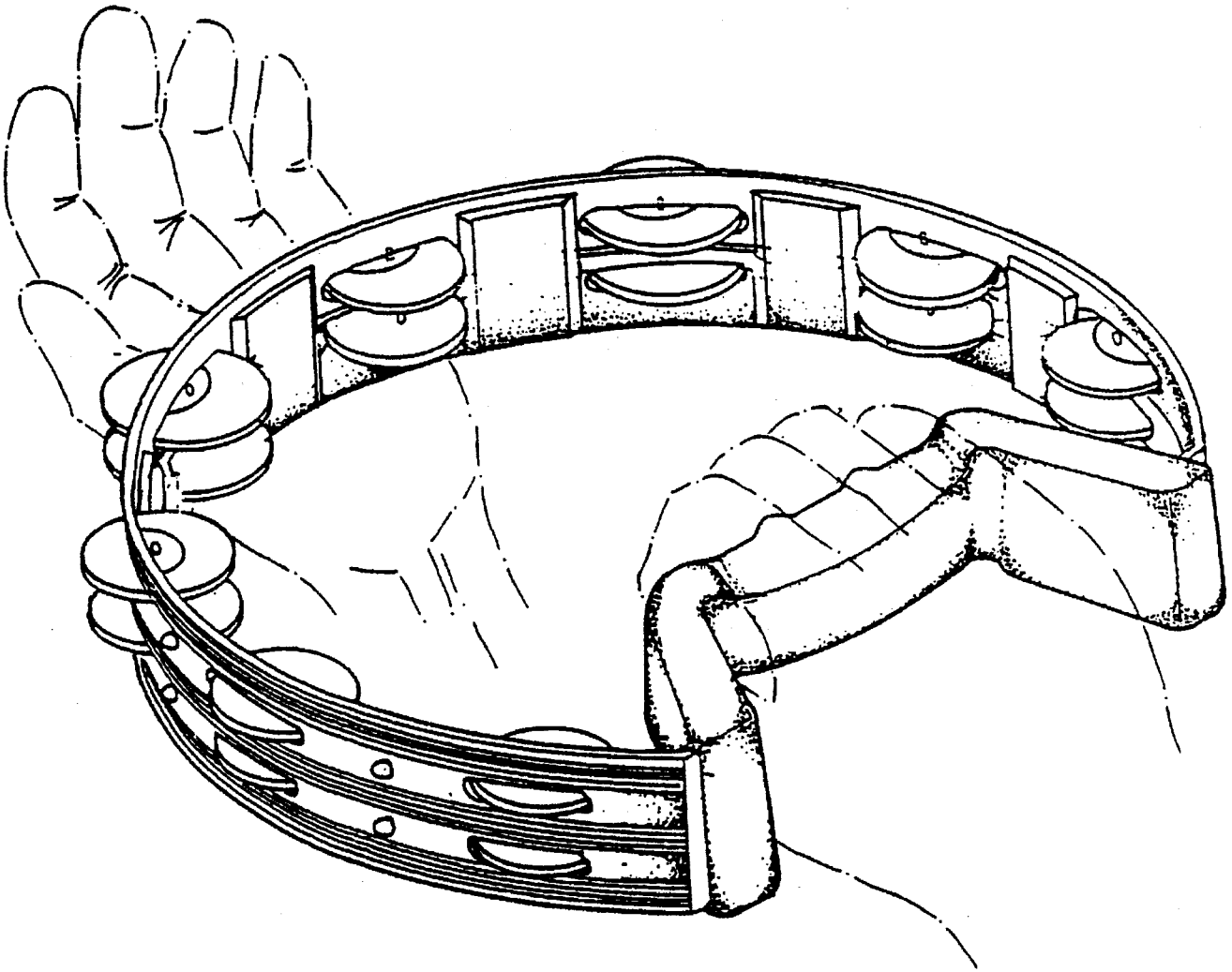
FIG. 5 is a perspective view of an embodiment of the present invention.

Referring to FIG. 5, when the user uses the present invention, the hand may hold the handle in perfect manner. Because the shape of the handle fits the hand, it will be comfortable for holding and striking without risk of slipping. When striking because electronic components are hit by jingles 22 to give a sound effect and further to control luminous body 30 on the tambourine collar 20 to give a flashing effect so as to increase the visual effects thereof.

Figure 6:
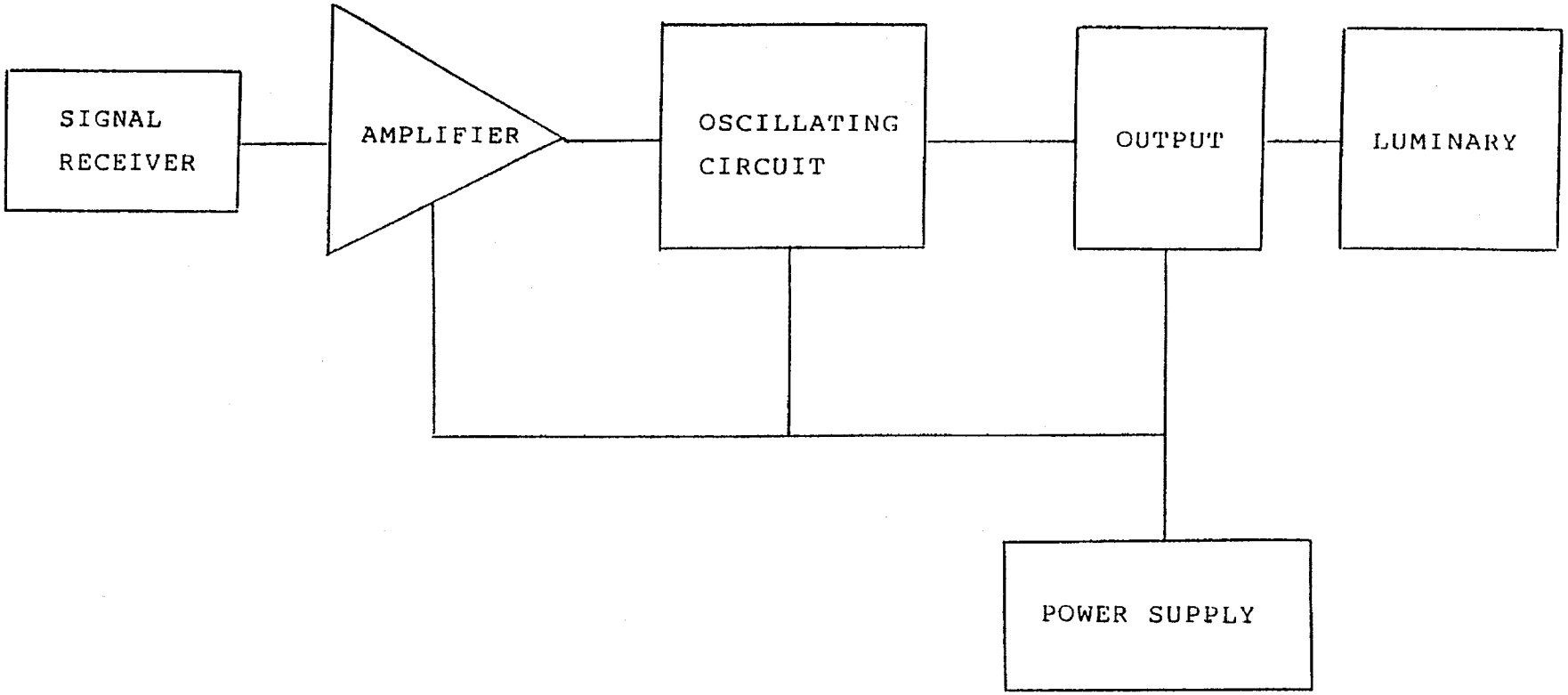
FIG. 6 is a block diagram showing a circuit of the present invention.
Figure 7:
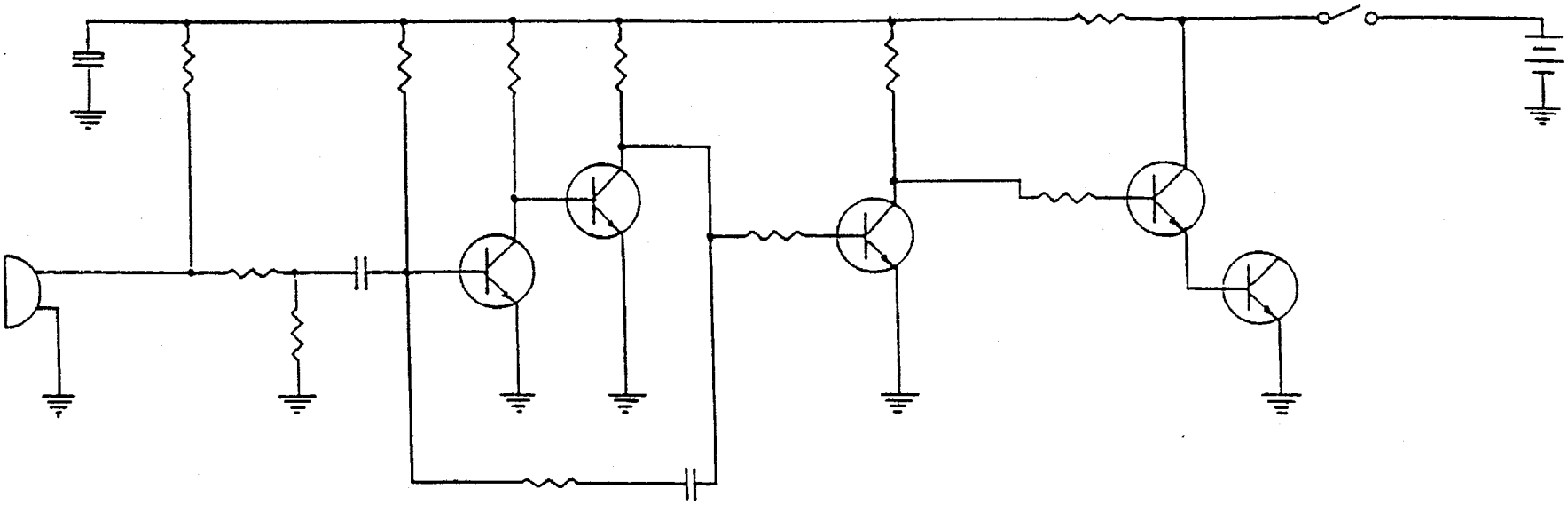
FIG. 7 is a schematic circuit diagram showing the circuit of the present invention.

Referring to FIGS. 6 and 7, the electronic circuit on the circuit board 11 may give a flashing effect when striking to achieve the amusing result.

To conclude above-said statement, the present invention has designed the handle to match with the way of hand holding and designed the setting of the tambourine collar to the optimal condition to ensure that the present invention will not be broken apart attached together. The cable on the tambourine collar is integrally protected by a cable protecting cover. Therefore its match, protection and pragmatism have reached the optimal result.

I claim:

1. An illuminated tambourine comprising:

a) a tambourine collar having first and second ends;

b) a plurality of luminous units located on the tambourine collar;

c) a handle attached to each of the first and second ends of the tambourine collar, the handle comprising:

i) a lower handle seat having a generally "U" shaped configuration, the lower handle seat having a retaining seat and a setting hole in opposite ends;

ii) an upper handle seat having a generally "U" shaped configuration, a battery holder configured to hold at least one battery, a removable battery cover covering the battery holder, a covering post on opposite ends of the upper handle seat, each said covering post having a setting post configured to engage a corresponding one of said retaining seats on the lower handle seat, and a printed circuit board mounted thereon; and, iii) a fastener inserted through each said setting hole and engaging each said covering post, respectively, to fasten the upper and lower handle seats together such that the first and second ends of the tambourine collar are fastened between said covering posts and said retaining seats;

d) an electrical cable connecting the printed circuit board and each of the plurality of luminous units and extending around the tambourine collar; and, e) a cable protecting cover attached to the tambourine collar and covering at least a portion of the electrical cable.

2. The illuminated tambourine of claim 1 further comprising:

a) a plurality of retaining blocks on the lower handle seat; and, b) a plurality of retaining slots in the :upper handle seat configured to be engaged by the retaining blocks.

* * * * *